US006110059A

United States Patent [19]

Haggarty

[11] Patent Number: 6,110,059

[45] Date of Patent: Aug. 29, 2000

[54] GOLF TEE

[76] Inventor: Shawn H. Haggarty, 22-28 Rainbow Drive, Woodbridge, Ontario, Canada, L4L 2K5

[21] Appl. No.: 09/121,397

[22] Filed: Jul. 23, 1998

[51] Int. Cl.[7] ..... A63B 57/00

[52] U.S. Cl. ..... 473/387

[58] Field of Search ..... 473/387–403; D21/717

[56] References Cited

U.S. PATENT DOCUMENTS

| | | | |
|---|---|---|---|
| D. 81,315 | 6/1930 | McLeod | D21/717 |
| 303,543 | 8/1884 | Prentiss | 473/388 |
| 1,614,499 | 1/1927 | Stirton | 473/389 |
| 1,636,655 | 7/1927 | Young | 473/387 |
| 1,738,596 | 12/1929 | McLeod | 473/391 |
| 1,759,657 | 5/1930 | McLeod | 473/387 |
| 1,783,211 | 12/1930 | Baldwin | 473/387 |
| 3,697,082 | 10/1972 | Di Laura et al. | 473/388 |

FOREIGN PATENT DOCUMENTS

| | | |
|---|---|---|
| 85 04 307 U | 6/1986 | Germany . |
| WO 90/14867 | 12/1990 | Japan . |
| 368568 | 3/1932 | United Kingdom . |
| 379917 | 9/1932 | United Kingdom . |
| 2 215 405 | 7/1989 | United Kingdom . |

*Primary Examiner*—Steven Wong

[57] ABSTRACT

A golf tee is formed in the shape of a hollow ring having one end for contacting the ground and another end for supporting a golf ball to be hit. The end for contacting the ground is formed with a series of points. The end for supporting the golf ball typically has contacts, or feet, for contacting the golf ball. The medial portion of the golf tee between the two ends can be thickened and can present a roughly horizontal surface upon which advertising may be placed. The golf tee is made of a reusable material and may have a sufficient internal diameter to permit the tee to be retrieved with the aid of the end of a golf club. The ends of the tee can be made to at least partially self-align, or self-center, to facilitate stacking. The medial portion of the tee has a relatively large space upon which a display can be placed, such as advertising, a logo, in a color that contrasts with the color of the body of the tee, to facilitate retrieval.

26 Claims, 4 Drawing Sheets

GOLF TEE

FIELD OF THE INVENTION

This invention relates to the field of golf tees.

BACKGROUND OF THE INVENTION

Golfers are familiar with the standard, stick type wooden golf tee which has a round shaft having a pointed lower end for penetrating turf and a broadened upper end with a concave surface for supporting a golf ball before the ball is struck with a suitable club. These tees have a number of disadvantages. First, they are generally considered to be disposable. Second, they tend easily to be broken when the ball is struck. Third, given their small size and shape, they may, if dislodged during striking of the ball, be difficult to find once the shot has been made. Fourth, they may not sit well on soggy ground, and may be difficult to drive into hard dry ground. Fifth, they may not sit at a consistent height. Sixth, they do not provide a significant surface area suitable for the display of advertising or promotional material.

Generally tubular golf tees are also known. For example, one known type employs a circular base and an upright tubular column having a cut end. This kind of tee is most commonly seen at driving ranges, and is used in conjunction with a rubber mat. The mat has a hole. The tubular shaft protrudes upwardly through the mat. These tees lack means for penetrating a surface. They are not known generally for use during a round of golf.

U.K. Patent Application GB 2 212 405 of Andiel, published Jul. 26, 1989 shows several variations of hollow, plastic golf tees that are of generally round cross-section. Each has a number of pointed tips around its periphery. The pointed tips at one end serve to rest on the ground, the pointed tips at the other end serve to support a golf ball before it is struck. Andiel also discloses making a large number of these tees by cutting them from adjacent sections of plastic tube stock, such as shown in Figures 8 and 9.

Another type of tubular tee, made of paper, and having serrated, or castellated ends, is shown in U.S. Pat. No. 1,614,499 issued Jan. 18, 1927 to Stirton. Paper may not be a satisfactorily durable material, particularly after several hits from a golf club, or if used in damp conditions. A subsequent style of stacking tubular tee, with or without serrated ends, is shown in U.S. Pat. No. 1,738,596 which issued Dec. 10, 1929 to McLeod. The angles of the serrations at opposite ends are different, so that the height achieved by stacking two of these tees together will vary depending on which ends of the tees are stacked together. In that patent, the inventor states that his tees are preferably formed from clays or earths such as to be disintegrable when struck by a golf club in play. This preference would not seem to encourage long life.

Since a golfer may desire tees of different heights, it is nonetheless advantageous for the tees to be capable of being stacked. In this regard, a tee in which the walls are made of excessively thin or weak materials may not be suitable for stacking or may require more care in stacking than a thicker walled tee or a tee made of more robust material. This is particularly so given the often highly sociable nature of golfing. For example, participants may take refreshments during a round of golf that may not improve the fine motor skills of the hand. Under such convivial circumstances golfers may prefer a tee with modestly forgiving self-aligning or self centering properties.

Furthermore, golfing is not infrequently an activity undertaken by business, educational or charitable entities, who may organise friendly tournaments, or golf days, for their customers, suppliers, clients, employees, or business and professional associates. In such circumstances the sponsor may wish to provide a remembrance of the event to the participants, whether emblazoned with its own indicia, or, more flatteringly, with those of the customer or group for whom this friendly entertainment is provided. It would be best for indicia on the tee to be in a form that is large enough to be easily discerned, and to be oriented in a manner for easy viewing when the tee is in use—observers should not have to crane their necks at an angle. It would therefore be advantageous for the tee to have a display surface of adequate size, oriented to lie horizontally during normal use. Such a display, if provided in satisfactorily remarkable size and adequately contrasting colour may also serve the functional purpose of aiding in the location of the tee when inadvertently struck by a club, more easily, perhaps, than a monochromatic tee. The inventor is unaware of any re-useable plastic tee that has been designed with the explicit purpose in mind of providing an adequate, outwardly facing surface for promotional messages or logos.

It would be advantageous to have a hollow type tee that is intended for prolonged, if not indefinite, use. It would also be advantageous to have a hollow tee that may be placed on dry hard ground, or be pushed into soft turf, and it would be advantageous for that tee to be made from a material that will resist damage even under repeated use. It would be advantageous to have a golf tee that is at least modestly self-aligning, or self-centering to facilitate stacking thereof with other tees, should a golfer wish. It would be advantageous to have a hollow tee of a robust medial section for holding between the fingers. Furthermore, it would be advantageous for that tee to have a large enough size to facilitate easy sighting after the shot has been taken, and also, of having a large enough hollow to admit the entry of the grip end of a golf club such that the tee may be picked up without the golfer having a need to bend over. It would also be advantageous for the tee to have, at its ball supporting end, ball supports of a sufficient radius not to present a sharply pointed tip.

SUMMARY OF THE INVENTION

In one aspect of the invention there is a re-usable golf tee comprising a hollow member having a first end for engaging a playing surface, a second end for supporting a golf ball and a medial portion between the first and second ends, the second end having at least three supports for supporting a golf ball. The supports having a characteristic wall thickness t that satisfies the formula $$t \geqq (\phi_{OD}/8)(1-\mathrm{Cos}(180/N))$$

where N is the number of supports, and $\phi_{OD}$ is the characteristic diametral dimension of the hollow member.

In an additional feature of that aspect of the invention, the golf tee has a medial portion of greater thickness than at least one of the first and second ends. In another additional feature of that aspect of the invention, the medial portion has a display surface whose major dimension is substantially horizontal when the tee is resting on a level playing surface. In yet another additional feature of this aspect of the invention, the medial portion includes an advertising surface for permitting a substantially horizontal display to be carried thereon, and that advertising surface has a height greater than 30% of the overall height of the tee. In other alternative tees, the medial portion has a substantially round cylindrical section, has an extent that is at least 40% of the overall height of the tee. In still other alternative tees, the advertising surface has a height that is at least 50% of the overall height of the golf tee.

In further additional features of this aspect of the invention, the wall thickness satisfies the equation $t \geqq (\phi_{OD}/4)(1-\mathrm{Cos}(180/N))$. In still other additional features of the invention, the wall thickness satisfies the equation $t \geqq (\phi_{OD}/2)(1-\mathrm{Cos}(180/N))$. In still other additional features of the invention, the number of supports, N, is an even number. In still other alternative additional features of the invention the number of supports, N, is at least 6. In another additional feature of the invention, the one end has a profile for interlocking with an end of another golf tee as claimed in claim 1. In a yet further additional feature of that aspect of the invention, the first and second ends have the same profile. In a still further additional feature of that aspect, the dimension t falls in the range of 0.030" to 0.125". In an alternative further additional feature of that aspect of the invention, the dimension t falls in the range of 0.040" to 0.95". In a still further alternative feature of that aspect of the invention, the dimension t falls in the range of 0.050" to 0.075". In a yet further still, additional feature of that aspect of the invention, the hollow member admits entry of the end of a golf club to facilitate retrieval thereof In another aspect of the invention, there is a reusable golf tee comprising a hollow member having a first end portion for engaging a playing surface, a second end portion for supporting a golf ball, and a thickened medial portion between the first and second ends. The second end has at least three golf ball supports spaced thereabout for contacting the golf ball.

In an additional feature of this aspect of the invention, the medial portion has a region that is stepped outwardly relative to the first and second ends. In an alternative to that additional feature, the medial portion has a region that is stepped inwardly relative to the first and second ends. In a still further alternative to that additional feature, the first end and the second end are stepped radially relative to each other whereby two of the tees can be stacked with one end portion of one tee radially nested within the other end of the other tee.

In another additional feature of that aspect of the invention, the medial portion has a region stepped outwardly and another region stepped inwardly relative to the first and second ends. In yet another additional feature of the invention, the medial portion presents a horizontally locatable display surface. In a further additional feature of that additional feature, the display surface has an image thereon for facilitating retrieval of the tee.

In another aspect, the invention includes a re-usable golf tee comprising a hollow member having a first end for engaging a playing surface, a second end for supporting a golf ball, and a medial portion between those ends, the second end having at least three supports spaced about the circumference of the hollow member, each support terminating in a foot for contacting the golf ball.

In another aspect of the invention the first, ground engaging end includes at least three ground engaging prongs for penetrating a playing surface. In an additional feature of that aspect of the invention the medial portion of the golf tee golf tee is of greater thickness than the first and second ends. In yet another additional feature of that aspect of the invention the golf tee also has a medial portion of sufficient breadth for the placement of advertising thereupon. In a further additional feature of that aspect, the golf tee is made from recycled rubber.

In a further aspect of the invention there is a re-usable golf tee having a hollow cylindrical member having a circumference. The hollow member has a first end portion for engaging a playing surface, a second end portion for supporting a golf ball, and a medial portion between the first and second end portions. The hollow member has an inwardly facing surface defining a passage fully therethrough. The medial portion has an outwardly facing display surface extending between the first and second end portions and the outwardly facing display surface has a height greater than 30% of the overall height of the tee. The medial portion has a wall thickness defined between the inwardly facing surface and the display surface. The second end portion has at least three supports spaced about the circumference of the hollow, member. The first end portion has a set of prongs for engaging the playing surface. The set of prongs correspond in height and number to the supports. The first end portion has an inside face, an outside face, and a first end portion wall thickness defined between the inside and outside faces thereof. The second end portion has an inside face, an outside face, and a second end wall thickness defined between the inside and outside faces thereof The medial portion wall thickness is greater than at least one of the wall thicknesses of the first and second end portions.

In a further aspect of the invention there is a hollow re-useable golf tee having a first end portion for engaging a playing surface, a second end portion having a plurality of supports for supporting a golf ball, and a medial portion between the first and second end portions. There is an outer wall surface. There is an inner wall surface defining a substantially cylindrical passageway through the golf tee. The supports have an inside face and an outside face parallel to the inside face. The second end portion has a second end portion thickness defined between the inside and outside faces of the supports. The first end portion has an inside face, an outside face parallel thereto, and a first end portion thickness defined therebetween. The first end portion has a set of prongs for engaging the playing surface. The set of prongs correspond in height to the supports. The medial portion has a wall thickness defined between the inner and outer wall surfaces. The wall thickness is greater than the thicknesses of the first and second end portions. The medial portion has an outwardly facing display surface. The outwardly facing display surface is round and cylindrical, and has a height greater than 30% of the overall height of the tee. At least one of the end portions has alignment flanks for urging the golf tee into stacked alignment with a second golf tee of similar type.

In still another aspect of the invention, there is a hollow, re-useable golf tee having a first end for engaging a playing surface, and a second end having a plurality of supports for supporting a golf ball. At least one of the ends has alignment flanks for urging the golf tee into stacked alignment with a second golf tee of similar type.

DETAILED DESCRIPTION OF THE INVENTION

Figure 1B:
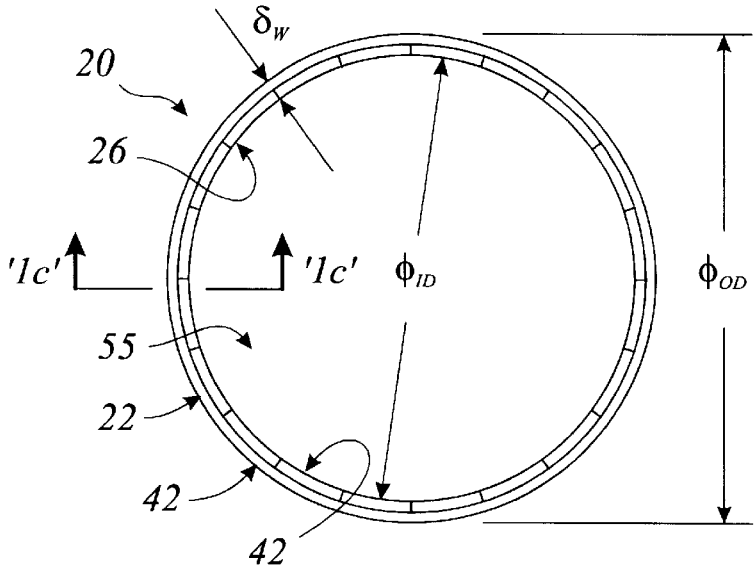
FIG. 1*b* is a plan view of the golf tee of FIG. 1*a*.
Figure 1C:
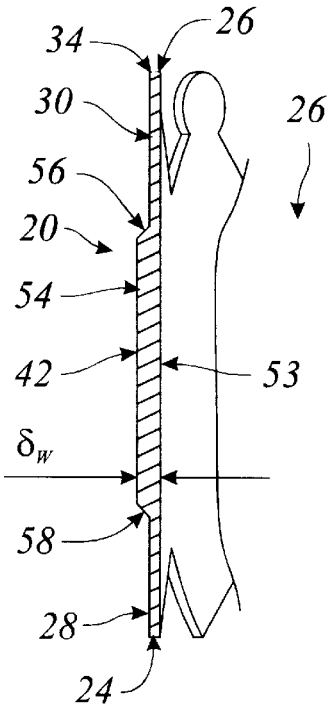
FIG. 1*c* is a view of the golf tee of FIG. 1*b* taken on section '1*c*—1*c*'.
Figure 1A:
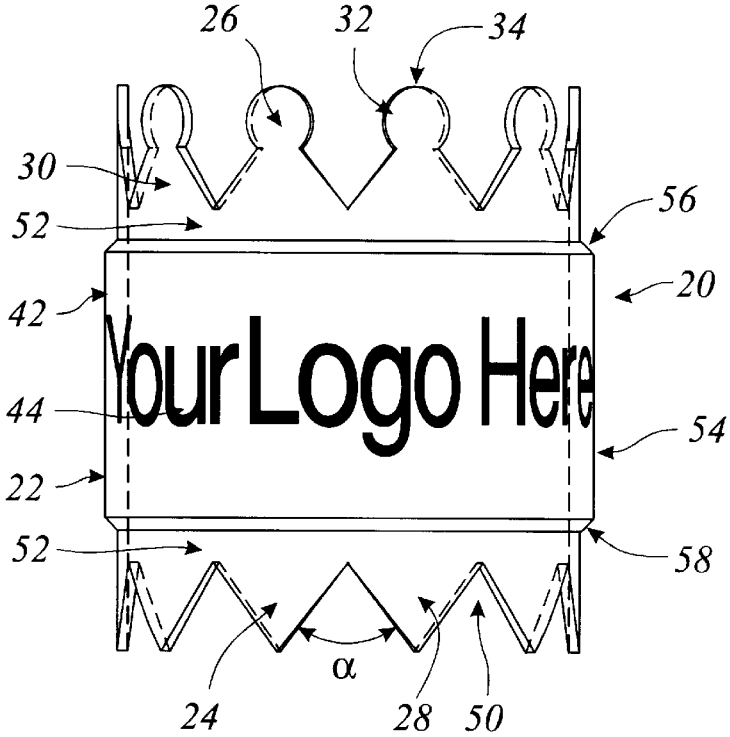
FIG. 1*a* is a profile view of an example of a golf tee embodying the principles of the present invention.

Referring to FIG. 1*a*, a golf tee is shown generally as 20. It has a body 22 having a first end 24 and a second end 26. First end 24 has a set of downwardly orientable prongs 28 for resting upon a flat surface, or for rooting into turf such as may be appropriate under given playing conditions. Second end 26 has a set of upwardly orientable supports 30 upon which a golf ball may be supported for striking.

It will be noted that each of supports 30 terminates in a distal end 32 having a bulbous termination, or foot 34, as distinct from a sharp point. In alternative embodiments foot 34 may have a largely circular profile, or oval, or rounded rectangular profile, or similar form, or even a small, radiused end such as to yield a non-sharp end surface.

Body 22 has a thickened medial portion 42 of sufficient breadth to permit a company name, such as a symbol, trade-mark or advertising logo 44 to be displayed. It is preferred that logo 44 be displayed in a bright or contrasting colour, or colours, in as large as possible a form to facilitate location of tee 20 should it be inadvertently displaced during driving of the ball. It is preferred that medial portion 42 be ¾" in height, thus permitting letters of up to 60 pt to be printed thereon. Further, logo 44 can be printed across medial portion 42 to appear roughly horizontally when tee 20 is in use. In an alternative embodiment, letters can be punched in or through the medial portion 42. In each case the major dimension of the display surface, that is, its circumference, will be generally horizontal in use on a roughly level playing surface.

In the embodiment of FIG. 1*a*, prongs 28 are ten in number and have a height from throat 46 to tip 48 of ¼" and the nominal included angle $\alpha$ of each relief 50 is 75°. Root land 52 is about ⅛" high.

Examining the embodiment of FIG. 1*b*, tee 20 has an external diameter, $\phi_{OD}$, and an inside diameter, indicated as $\phi_{ID}$. Notably, as seen in the section of FIG. '*c*—1*c*' medial portion 42 is thickened relative to either of the ends 24 or 26. That is, it has a wall thickness, indicated as $\delta_W$ that is greater than the thickness of either prongs 28 or supports 30, outer wall surface 54 being stepped outwardly at shoulders 56 and 58. In the preferred embodiment $\delta_W$ is 0.06" and the thickness prongs 28 and supports 30 is about 0.04". Similarly, the overall diameter of medial portion 42 is greater than the overall characteristic diametral dimension taken over the tips of supports 30. That is, medial portion 42 has a substantially round cylindrical section, as illustrated. Medial portion 42 also has an inner wall surface 53 defining a passage, indicated generally as 55, extending through tee 20.

The preferred from a tube described above is a molded part. It could also be machined from a tube of suitable diameter, wall thickness, and material, such as nylon, ABS or other plastic. The golf tee may also be made of moulded, recycled rubber. Recycled rubber is relatively durable, and is readily available.

The dimensions of tee 20 may vary. The height of medial portion 42 may be as small as about ⅜", that is, about 25% of tee height, is as large as 1 3/16", that is, about 75% of tee height. That is, medial portion 42 has an advertising surface permitting a substantially horizontal display to be carried thereon, the advertising surface having a height greater than 30% of the overall height of tee 20. A more preferred range is from ½" to 1", being roughly ⅓ to ⅔ of overall tee height.

Similarly wall thickness $\delta_W$ may vary depending on the material chosen, the amount of stiffness, or conversely, flexibility desired, and the ease of moulding of the design. Prongs 28 and end supports 30 need not be of the same thickness, and need not be of constant thickness.

The height of prongs 28 may be as little as ⅛" and as much as ½". The number of points of contact of prongs 28 with the playing surface, or points of contact of supports 30 with a golf ball, ought not to be fewer than 3, as a condition of general stability, but can be a greater number such as may be found suitable. As the number of points of contact of supports 30 increases the effect is to approach, in the limit, an infinite number of points defining an arc, or opposed arcs, of contact sufficient to give stability. The overall diameter of tee 20 may range from as little as ⅝" to a value approaching the outside diameter of the golf ball itself, particularly if supports 30 are inclined inwardly from medial portion 42. The inside diameter can be such as to permit the hand grip end of most golf clubs to be inserted therein, facilitating retrieval of the tee. An inside diameter of about 1 3/16" can be used, although lesser diameters, such as ⅞", 1" or 1⅛", may also be satisfactory for some golf clubs. It is not necessary that the inside face be circular in section, but could be oval, or some other suitable shape. The internal face could, for example, be shaped to match the size and profile of a particular type or brand of golf club. In the preferred embodiment the inside face is round in cross-section as this is convenient.

Figure 2B:
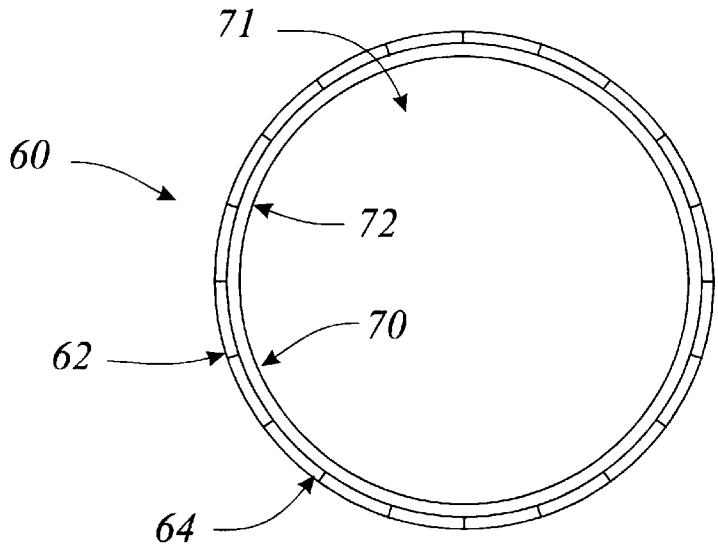
FIG. 2*b* is a plan view of the golf tee of FIG. 2*a*.
Figure 2C:
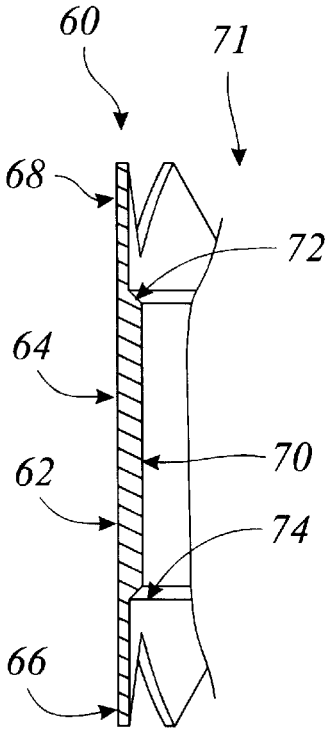
FIG. 2*c* is a view of the golf tee of FIG. 2*b* taken on section '2*a*—2*a*'.
Figure 2A:
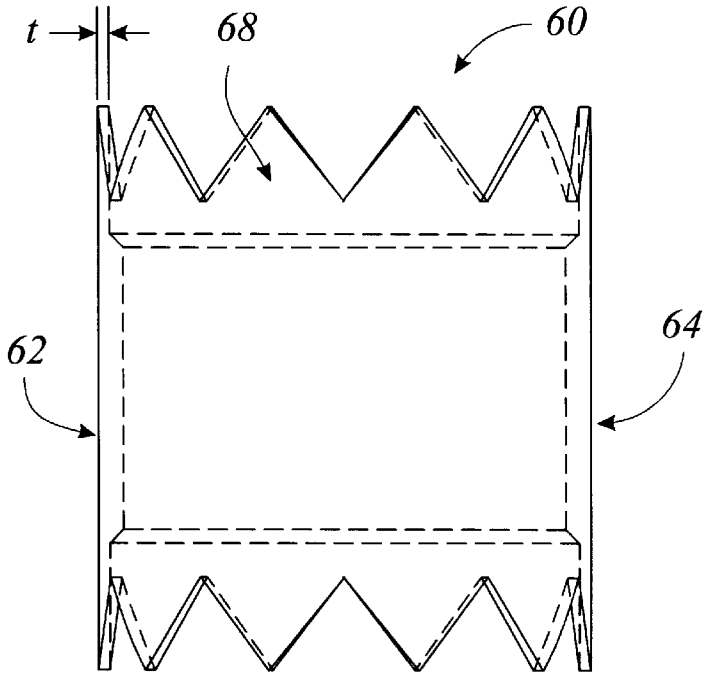
FIG. 2*a* is a profile view of an alternative embodiment of golf tee to that shown in FIG. 1*a*.

Alternate embodiments of golf tees are illustrated in FIGS. 2*a*, 2*b*, 2*c*, 2*c*, 3*a*, 3*b*, 3*c*, 4 and 5. In the embodiment of FIGS. 2*a*, 2*b* and 2*c*, a golf tee 60 has a thickened medial portion 62 in which the outside wall surface 64 is straight from prongs 66 to sharp ended supports 68, while inside wall surface 70 is stepped inwardly at shoulders 72 and 74. Inside wall surface 70 defines a passage, indicated generally as 71, through tee 60.

Figure 3B:
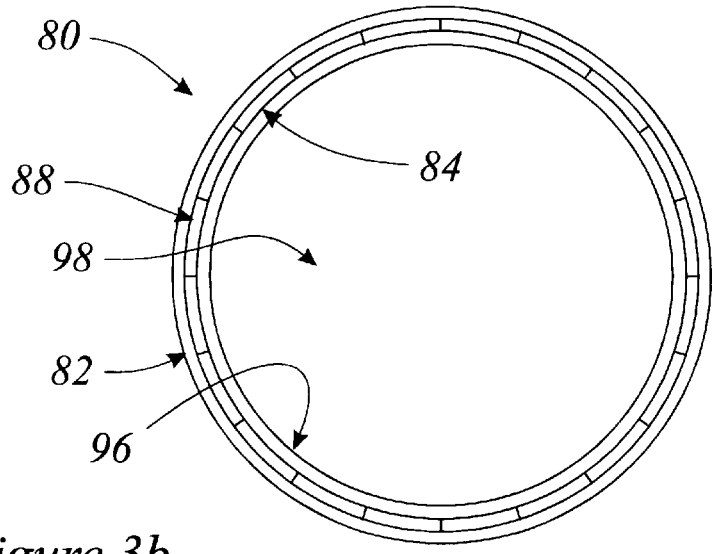
FIG. 3*b* is a plan view of the golf tee of FIG. 3*a*.
Figure 3C:
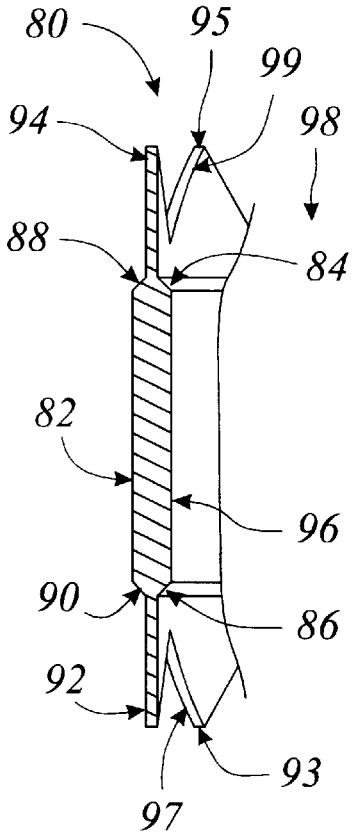
FIG. 3*c* shows a view of the golf tee of FIG. 3*c* taken on section '3*c*—3*c*'.
Figure 3A:
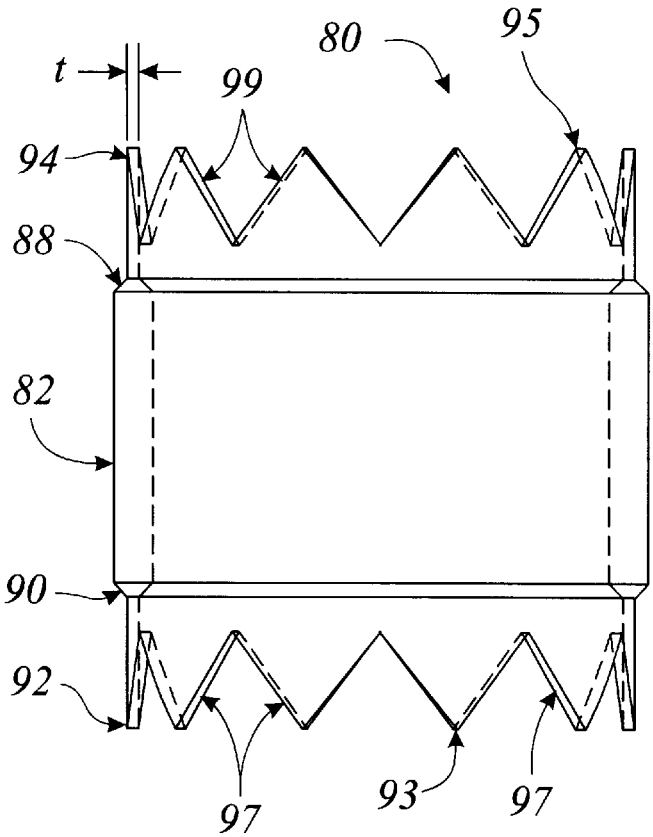
FIG. 3*a* is a profile view of a further alternative embodiment of golf tee to that shown in FIG. 1*a*.

In the preferred embodiment of FIGS. 3*a*, 3*b* and 3*c* a golf tee 80 has a thickened medial portion 82 that is stepped both inwardly at chamfered shoulders 84 and 86, and stepped outwardly at chamfered shoulders 88 and 90. Tee 80 is shown with prongs 92 and sharp ended supports 94. Tee 80 has an inwardly facing inside wall surface 96 defining a passage, indicated generally as 98, through tee 80.

Figure 4:
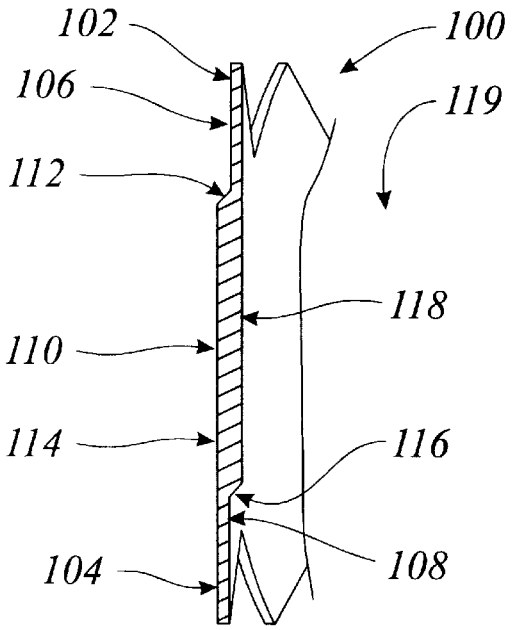
FIG. 4 shows an alternative golf tee cross section to that shown in FIG. 1*c*.

In the embodiment of FIG. 4 a golf tee 100 has sharp ended supports 102 that are stepped inwardly relative to prongs 104. Outer walls 106 of supports 102 is of a diameter suitable for nesting radially within the diameter of inner wall 108 of prongs 104. A thickened medial portion 110 is formed by chamfering support outer wall 106 outward at an upper shoulder 112 to meet outer main wall surface 114 and by chamfering prong inner wall 108 inward at lower shoulder 116 to meet inner main wall surface 118. Inner main surface defines a passage, indicated generally as 119, through tee 100. Tees made in this way will stack with one set of supports 102 at lease partially nested within another set of prongs 104. Alternatively, the step could be reversed with prongs 104 nesting within supports 102 of an adjacent tee.

The change in thickness from the thickened medial portion to the tips can be discrete, as illustrated in figures 1*c*, 2*c*, 3*c* and 4, in which the thickness changes abruptly at a chamfer or shoulder. Alternatively the variation in thickness may be more gradual whether as a continuous taper or as a taper of a longer transition than the shoulders illustrated.

The golf tee illustrated in FIG. 3a has ten tips on both the playing surface engaging end and on the golf ball engaging end. It exhibits a self-aligning, or self-centering feature, in that the prongs 92 and supports 94 are sufficiently numerous, and the wall thickness of their respective tips is sufficiently great, that provided the placement of one tee upon another is reasonably close, the tips 93 or 95, as the case may be, will encounter, an begin to ride against, flanks 97 or 99, as the case may be, of the other tee, and in so doing tend to be urged into their correct seating positions. If the number of prongs or supports that are to stack on a given end is 'N', the support thickness is 't', the outside diameter of the supports is $\phi_{ODS}$, and the angular pitch of the prongs is defined as (360/N) then, for a ½ pitch angular or translational mismatch, self-centering will occur if $t \geqq \phi_{ODS}$ (1−Cos (180/N)). A less pronounced self-centering effect is present over a smaller mismatch even for significantly thinner wall thicknesses, such as, for example, even an ⅛, a ⅙, a ⅕, a ¼, a ⅓, or a ½of this value. It is preferred that the wall thickness be ⅓ of this value or more. It is also preferred that the wall thickness not be excessive, since this would result in an unnecessary waste of material, and needless weight. To that end, wall thicknesses in the range of 0.020" to 0.125" may be suitable depending on the number of prongs and supports, density, elasticity, and other properties of the material chosen. Wall thicknesses in the range of 0.030" to 0.094" may be desirable. Wall thicknesses in the range of 0.350" to 0.063" (that is, roughly 1/16") may be highly desirable, 0.035 being preferred.

Figure 6:
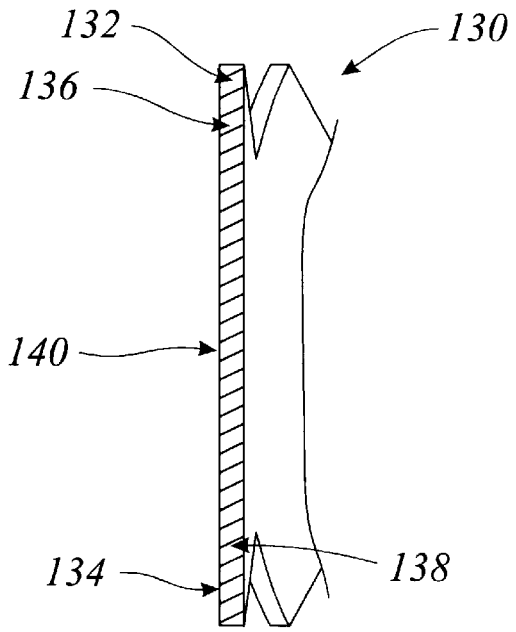
FIG. 6 shows an alternative golf tee cross section to that shown in FIG. 1*c*.

This self-centering feature does not depend on the thickness of the medial portion being greater than the thickness of either, or both, of the end portions, and could be achieved with a tee of constant thickness. FIG. 6 shows a cross-sectional view of a golf tee of constant thickness, indicated generally as 130 having a support 132 at one end 136 and playing surface engaging prongs 134 at the other end 138. Medial portion 140 is shown having the same thickness as both ends 136 and 138. In this embodiment supports 132 and prongs 134 have the same profile, pitch, and number. As such tee 130 ends 136 and 138 are interchangeable, and suited to self-centering engagement when one such tee 130 is stacked upon another. It appears that tees with an even number of supports or prongs self-center well, possibly because each pair of diametrically opposed supports or prongs form a "couple".

It is not necessary that the tees, such as tees 20, 60 and 80 have prongs or supports at every pitch around their peripheries to self center and to remain within the principles described. A prong or support could be omitted, like a missing tooth, or teeth, and self centering could still occur provided a sufficient number of prongs or supports remain to satisfy the geometric requirements for self centering.

In that same vein, without departing from the stacking principle, a tee with six prongs (for example on 60 degree centers if on uniform pitch), may be stackable with either an end support having 3 prongs, or supports (for example, on 120 degree centres, if on uniform pitch), or with an end having 4 prongs or supports, (for example on alternating 60 degree and 120 degree pitches).

Two different types of stacking are possible with different styles of tee. First, in the case of the embodiment of FIG. 4, when the tips of one set of prongs 104 ride on a shoulder 112 of another tee, or, the tips of supports 106 ride on shoulder 116, as the case may be, the stacked tees are forced to rotate one with respect to the other about their common longitudinal axis. This rotation may be prevented by forming the tee of non-circular section or by providing the tee with a stop on either the outside face 106 of support 102 or the inside face 108 of prong 104 for catching in a rebate 107 or 109 between adjacent supports, or prongs, as the case may be. Second, stacking in the manner of cups can be achieved with a tee having a tapered truncated conical section.

Notwithstanding these alternatives, the self-centering stacking capability of the embodiment of FIG. 3 is preferred.

Figure 5:
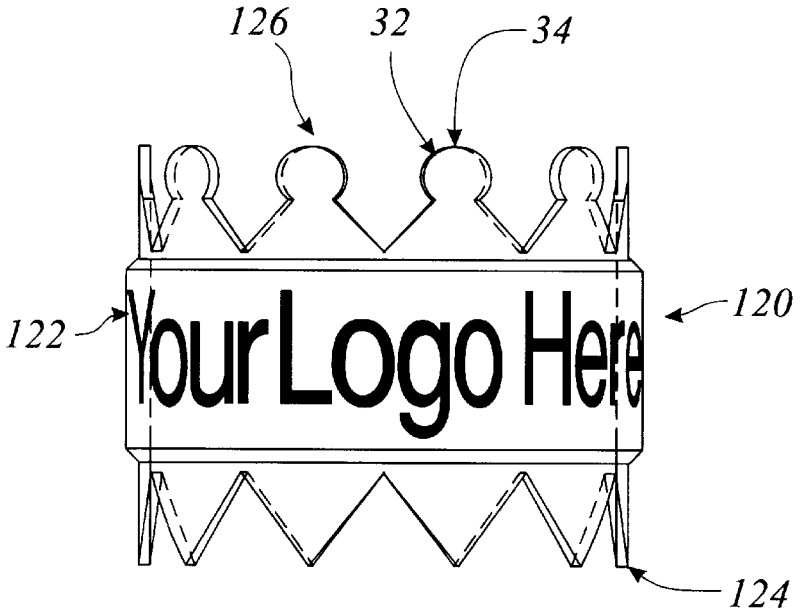
FIG. 5 shows a profile view of a golf tee similar to the golf tee of FIG. 1*a*, but of diminished height.

In FIG. 5, a tee 120 is shown having altered properties such that medial portion 122 is of diminished height and has prongs 124 and bulbous ended supports 126. Tee 120 can be used alone or can be stacked with other tees of the same height, or tees of greater height such as tee 60, for example.

It will be noted that hollow tees of oval, elliptical or polygonal form can be made without departing from the spirit of the invention herein. In such cases it is a reasonable approximation to define a characteristic diametral dimension analogous to $\phi_{OD}$, as the hydraulic diameter $\phi_H$ of the section, according to the equation $\phi_H$=4(A/P) where A is the area of the section and P is the perimeter.

Although specific examples of embodiments of the invention herein have been described, the invention is not to be limited to those embodiments but to the principles of the invention as set forth in the claims to be appended hereto, and to the functional and mechanical equivalents thereof.

I claim:

1. A re-usable golf tee comprising:

a hollow member having a first end portion for engaging a playing surface, a second end portion for supporting a golf ball, and a medial portion between said first and second end portions;

said member having an inwardly facing surface defining a passage therethrouqh;

said medial portion and said first end portion meeting at a first shoulder;

said medial portion and said second end portion meeting at a second shoulder;

said medial portion having an outwardly facing display surface extending between said first and second end portions;

said second end portion having at least three supports spaced thereabout for engaging the golf ball said first end portion having a set of prongs for engaging the playing surface.

2. A golf tee as claimed in claim 1, wherein:

said medial portion a medial portion wall thickness defined therebetween between said inwardly facing surface and said outwardly facing display surface;

said first end portion has a wall thickness;

said second end portion has a wall thickness; and said medial portion wall thickness is greater than at least one of the wall thicknesses of said first and second end portions.

3. the golf of claim 1, wherein said tee has an overall height, said display surface is an advertising surface permitting a substantially horizontal display to be carried thereon, and said advertising surface has a height greater than 30% of the overall height of said tee.

4. The golf tee of claim 3 wherein said medial portion has a substantially round cylindrical section, and said medial portion has an extent that is at least 40% of the overall height of said tee.

5. The golf tee of claim 1 wherein:

when said prongs engage the playing surface said supports stand upwardly of said medial portion and said prongs extend downwardly of said medial portion;

said supports are arrayed about a pitch circle having a diametral dimension $\phi$;

said prongs are arrayed about a pitch circle also having diametral dimension $\phi$;

said supports and said prongs having flanks of mating profile;

said supports and said prongs are equal in number, said number being designated as N; and said supports have a wall thickness t that satisfies the equation $$t \geq (\phi/4)(1-\mathrm{Cos}(180/N)).$$

6. The golf tee of claim 5 wherein said wall thickness t satisfies the equation $$t \geq (\phi/2)(1-\mathrm{Cos}(180/N)).$$

7. The golf tee of claim 5 wherein said number, N, is an even number.

8. The golf tee of claim 5 wherein said number, N, is at least 6.

9. The golf tee of claim 1 wherein said one end portion has a profile for interlocking with an end portion of another golf tee as claimed in claim 1.

10. The golf tee of claim 1 wherein said first and second end portions have the same profile.

11. The golf tee of claim 5 wherein dimension t falls in the range of 0.020" to 0.125".

12. The golf tee of claim 5 wherein dimension t falls in the range of 0.030" to 0.95".

13. The golf tee of claim 5 wherein dimension t falls in the range of 0.035" to 0.063".

14. The golf tee of claim 1 wherein said hollow member admits entry of an end of a golf club to facilitate retrieval thereof.

15. A reusable golf tee comprising:

a hollow member having a first end portion for engaging a playing surface, a second end portion for supporting a golf ball, and a medial portion between said first and second end portions;

said medial portion having the form of an annular wall of circular cross-section, said wall having an inner diameter, an outer diameter and a wall thickness;

said medial portion having an inner wall surface defining a passageway therethrough;

said medial portion having an outer wall surface defining an external display surface;

said outer wall surface meeting said first end portion at a first circumferential shoulder;

said outer wall surface meeting said second end portion at a second circumferential shoulder;

said first end portion having a first set of prongs for engaging the playing surface, said first set of prongs being spaced about and extending away from said first shoulder; and said second end portion having a second set of prongs, said second set of prongs being spaced about and extending away from said second circumferential shoulder.

16. The reusable golf tee of claim 15 wherein said outer wall surface of said medial portion is stepped outwardly relative to the first and second end portions.

17. The reusable golf tee of claim 2 wherein said inwardly facing surface is stepped inwardly relative to the first and second end portions.

18. The reusable golf tee of claim 15 wherein said first and second end portions are stepped radially relative to each other whereby two of said tees can be stacked with one end portion of one tee radially nested within the other end of the other tee.

19. The reusable golf tee of claim 15 wherein said medial portion has a region stepped outwardly and another region stepped inwardly relative to said first and second end portions.

20. The reusable tee of claim 15 wherein said display surface has a contrasting image thereon for facilitating retrieval of said tee.

21. The reusable golf tee of claim 2 wherein said supports each terminate in a blunt foot for supporting the golf ball.

22. The reusable golf tee of claim 21 wherein said foot has a bulbous profile.

23. A re-useable golf tee comprising:

a hollow cylindrical member having a circumference;

said hollow member having a first end portion for engaging a playing surface, a second end portion for supporting a golf ball, and a medial portion between said first and second end portions;

said hollow member having an inwardly facing surface defining a passage fully therethrough;

said medial portion having an outwardly facing display surface extending between said first and second end portions and said outwardly facing display surface having a height greater than 30% of the overall height of said tee;

said medial portion having a wall thickness defined between said inwardly facing surface and said display surface;

said second end portion having at least three supports spaced about the circumference of the hollow member;

said first end portion having a set of prongs for engaging the playing surface;

said set of prongs corresponding in height and number to said supports;

said first end portion having an inside face, an outside face, and a first end portion wall thickness defined between said inside and outside faces thereof; and said second end portion having an inside face, an outside face, and a second end wall thickness defined between said inside and outside faces thereof; and said medial portion wall thickness is greater than at least one of the wall thicknesses of said first and second end portions.

24. A hollow re-useable golf tee having:

a first end portion for engaging a playing surface, a second end portion having a plurality of supports for supporting a golf ball, and a medial portion between said first and second end portions;

an outer wall surface;

an inner wall surface defining a substantially cylindrical passageway through said golf tee;

said supports having an inside face and an outside face parallel to said inside face, said second end portion having a second end portion thickness defined between said inside and outside faces of said supports;

said first end portion having an inside face, an outside face parallel thereto, and a first end portion thickness defined therebetween;

said first end portion having a set of prongs for engaging the playing surface;

said set of prongs corresponding in height to said supports;

said medial portion having a wall thickness defined between said inner and outer wall surfaces, said wall thickness being greater than said thicknesses of said first and second end portions;

said medial portion having an outwardly facing display surface, said outwardly facing display surface being round and cylindrical, and having a height greater than 30% of the overall height of said tee; and at least one of said end portions having alignment flanks for urging said golf tee into stacked alignment with a second golf tee of similar type.

25. The golf tee of claim 24 wherein said golf tee has a pair of castellated ends of mating profiles, and said flanks are inclined surfaces of the castellations of at least one of said ends.

26. The golf tee of claim 24 wherein said golf tee has a cylindrical plan form, said first end has at least six prongs for engaging said playing surface arrayed thereabout, the number of said supports of said second end arrayed thereabout, N, is at least six, said prongs and said supports having mating profiles, said mating profiles include said alignment flanks, said prongs and said supports have the same outside diameter, $\phi$, and the same wall thickness, t, such that $t \geqq (\phi/2)(1-\cos(180/N))$, and said golf tee has a medial portion between said ends that has a wall thickness greater than t.

* * * * *